US010245208B2

(12) United States Patent
MacGuinness

(10) Patent No.: US 10,245,208 B2
(45) Date of Patent: Apr. 2, 2019

(54) THERAPEUTIC DEVICE

(71) Applicant: HORSEWARE PRODUCTS LTD., Dundalk, Co. Louth (IE)

(72) Inventor: Thomas Peter MacGuinness, Dromiskin (IE)

(73) Assignee: HORSEWARE PRODUCTS LTD., Dundalk, Co. Louth (IE)

( * ) Notice: Subject to any disclaimer, the term of this patent is extended or adjusted under 35 U.S.C. 154(b) by 297 days.

(21) Appl. No.: 14/180,443

(22) Filed: Feb. 14, 2014

(65) Prior Publication Data

US 2014/0236056 A1 Aug. 21, 2014

(30) Foreign Application Priority Data

Feb. 15, 2013 (IE) ..... S2013/0054

(51) Int. Cl.
*A61H 23/02* (2006.01)
*A61H 11/00* (2006.01)

(52) U.S. Cl.
CPC ..... *A61H 23/02* (2013.01); *A61H 11/00* (2013.01); *A61H 23/0263* (2013.01); *A61H 2201/164* (2013.01); *A61H 2201/165* (2013.01); *A61H 2201/1635* (2013.01); *A61H 2203/03* (2013.01); *A61H 2205/06* (2013.01); *A61H 2205/10* (2013.01)

(58) Field of Classification Search
CPC ..... A61H 23/02; A61H 23/00; A61H 11/00; A61H 23/0263; A61H 2203/03; A61H 2201/165; A61H 2201/5028; A61H 2201/5025; A61H 2201/169
See application file for complete search history.

(56) References Cited

U.S. PATENT DOCUMENTS 2,943,620 A * 7/1960 Sibert ..... A61H 23/02 5/421
4,343,303 A * 8/1982 Williams ..... A61H 23/02 601/39
4,559,929 A * 12/1985 Hseu ..... A61H 23/0263 366/111
5,334,131 A * 8/1994 Omandam ..... A61H 23/0263 601/70
5,902,256 A * 5/1999 Benaron ..... A61H 23/0263 601/108
6,537,235 B1 * 3/2003 Connor ..... A41D 23/00 2/207
6,554,787 B1 * 4/2003 Griffin ..... A61F 7/02 601/70

(Continued)

*Primary Examiner* — Colin W Stuart
*Assistant Examiner* — Douglas Sul
(74) *Attorney, Agent, or Firm* — Birch, Stewart, Kolasch & Birch, LLP

(57) ABSTRACT

A therapeutic device for treating a limb of a human or a non-human animal, has an elongate, flexible panel, at least one vibrating source in the form of an electric motor driving an eccentric element to produce vibrations at a rate in a range up to 30 Hz, a battery and a control unit, all being embedded within the elongate, flexible panel, and connected together by wiring (not shown), which wiring is also embedded within the elongate, flexible panel. As the wiring is embedded within the elongate flexible panel it cannot be interfered with, in use, with the attendant advantages.

10 Claims, 2 Drawing Sheets

(56) References Cited

U.S. PATENT DOCUMENTS

| | | | | |
|---|---|---|---|---|
| 6,675,743 | B1 * | 1/2004 | Jeffrey | A01K 13/006 119/850 |
| 6,929,612 | B2 * | 8/2005 | Mangano | A61H 11/00 601/71 |
| 7,297,126 | B2 * | 11/2007 | Kries | 5/915 |
| 8,308,665 | B2 * | 11/2012 | Harry | A43B 3/0005 601/22 |
| 8,708,416 | B2 * | 4/2014 | Stronconi | A47C 20/02 297/397 |
| 2002/0169398 | A1 * | 11/2002 | Hancock | A61F 7/007 601/15 |
| 2005/0070827 | A1 * | 3/2005 | Lee | A61H 23/0263 601/57 |
| 2005/0234373 | A1 * | 10/2005 | Khalaf | A61H 23/0263 601/71 |
| 2007/0167885 | A1 * | 7/2007 | Moon | A61H 11/00 601/71 |
| 2008/0288035 | A1 * | 11/2008 | Gill | A61F 7/007 607/108 |
| 2010/0262050 | A1 * | 10/2010 | Gasparovich | A47C 21/006 601/57 |
| 2012/0253236 | A1 * | 10/2012 | Snow | A61N 7/00 601/2 |

* cited by examiner

THERAPEUTIC DEVICE

This invention relates to a therapeutic device for treating a limb of a human or a non-human animal and, in particular, to a therapeutic device incorporating a vibration source.

By a therapeutic device in this context is meant a device for providing circulation treatment to a limb, both before or after exercise or during rehabilitation.

Therapeutic devices incorporating a vibration source are known. These devices can be used in combination with the application of heat or cold to the limb. Such therapeutic devices may be self-contained or may be incorporated into a support, which wraps around the limb.

A circulation therapy kit for the treatment of a horse's leg is marketed by Horseware Products Ltd, of Finnabair Industrial Estate, Dundalk, County Louth, Ireland under the brand ICE-VIBE (ICE-VIBE is a registered trade mark). The kit consists of a pair of leg boots, vibrating panels, rechargeable batteries/control units, cold packs, a battery charger and associated wiring.

If being used, a cold pack is first wrapped around the leg of the horse and is secured in place. A leg boot wraps around the leg, over the ice pack, if used. The horse boot has a number of pockets on the inner surface thereof for retaining a vibrating panel therein. A rechargeable battery/control unit is placed in a further pocket on the leg boot and is connected to the vibrating panel by a wire. An on/off button on the control unit is operated to initiate an intermittent vibration treatment. The vibrations stimulate the blood circulation in the leg to minimise damage to the leg in the normal exercise of the horse and to repair damage to the leg.

However, it has been found that, where a horse, particularly a young horse, is left unattended during treatment with the boot, he can interfere with the boot and cause damage to the wiring between the rechargeable battery/control unit and the vibration panel and/or to himself.

It is an object of the present invention to overcome the disadvantages of the therapeutic device hereinbefore described.

Thus, the invention provides a therapeutic device for treating a limb of a human or a non-human animal, the therapeutic device comprising an elongate, flexible panel, at least one vibrating source, a battery and a control unit, all being embedded within the elongate, flexible panel, and connected together by wiring, which wiring is also embedded within the elongate, flexible panel.

An advantage of the therapeutic device according to the invention is that all of the components, including all wiring, are embedded within the elongate, flexible panel. Thus, any danger of the device being damaged due to interference with the wiring, as in the prior art device has been eliminated.

A further advantage of the therapeutic device is that, since he panel is flexible it can be moulded to conform to the area of the limb to be treated.

Preferably, the battery is rechargeable and a socket, for attaching a charging unit thereto, is accessibly mounted in the outer surface of the elongate flexible panel.

As the battery is embedded within the elongate, flexible panel, it makes sense that it is rechargeable, as this prolongs the working life of the device.

In one embodiment of the invention, the control unit has an on/off button mounted thereon, which button is operable by applying pressure, through the outer surface of the elongate, flexible panel, at a position overlying the on/off button.

An advantage of having the on/off button embedded within the elongate, flexible panel is that it is protected from the elements along with the control unit, thus reducing the likelihood of the device failing due, for example, to damage from water.

In a further embodiment of the invention, the elongate, flexible panel is adapted to be locatable within a pocket in a wrap, which wrap is dimensioned to fit around a part of the limb to be treated.

An advantage of the therapeutic device is that it can be applied to treatment of different areas of the limb. Thus, in the case of a horse, wraps can be designed for the treatment of the foreleg, the knee and the hock, and the device will be suitable for each application.

The invention will be further illustrated by the following description of an embodiment thereof, given by way of example only with reference to the accompanying drawings in which.

Figure 1:
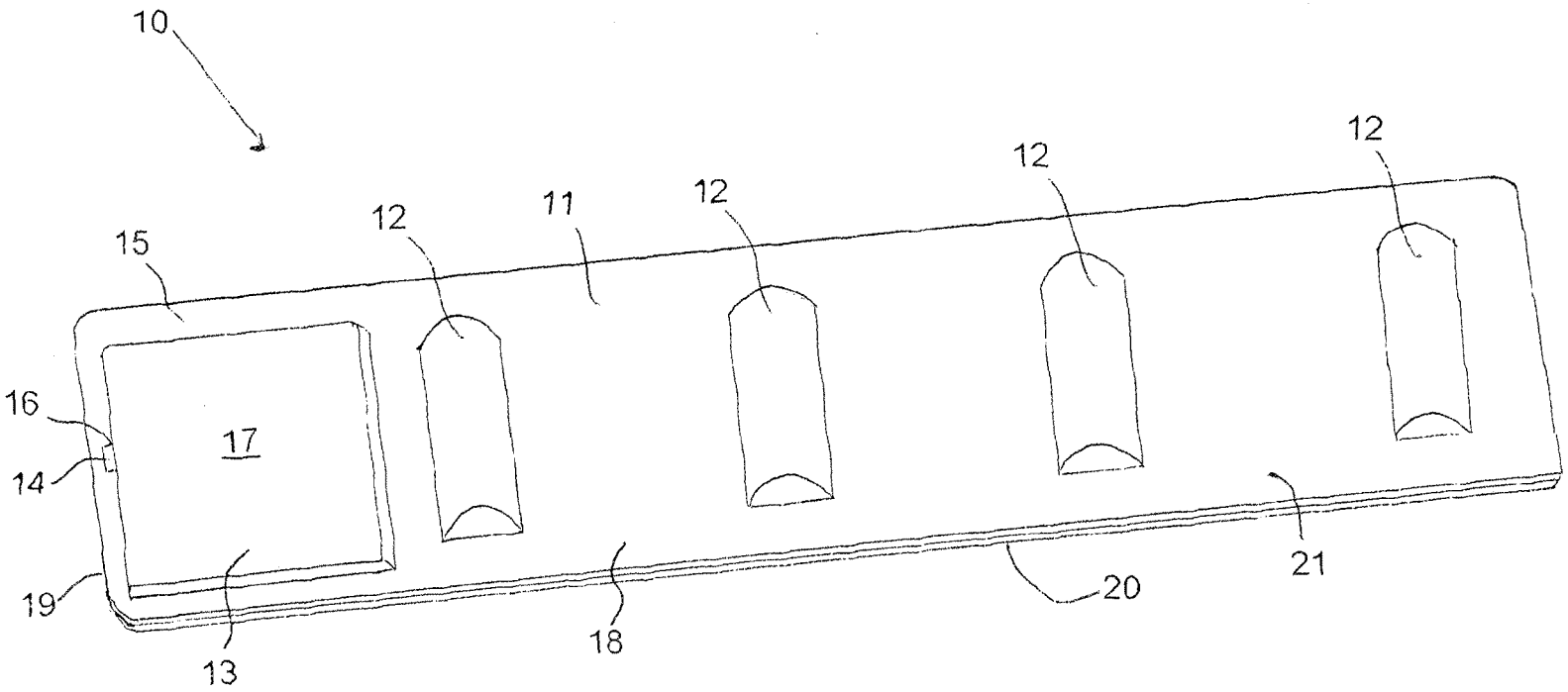
FIG. 1 is a perspective view of a therapeutic device in accordance with the invention.

Referring to FIG. 1, there is illustrated generally at 10, a therapeutic device for treating a limb of a human or a non-human animal in accordance with the invention. The therapeutic device 10 consists of an elongate, flexible panel 11, with four vibrating sources in the form of electric motors (not shown), with each motor driving an eccentric element to produce vibrations at a rate in a range up to 30 Hz, which electric motors are embedded in recesses 12 therein. A rechargeable battery and a control unit battery (not shown) are embedded in a control recess 13 within the elongate, flexible panel 11. The electric motors, battery and control unit are connected together by wiring, which wiring is also embedded within the elongate, flexible panel 11.

A socket 14 is mounted in outer surface 15 of the elongate flexible panel 11 at position 16.

The control unit has an on/off button (not shown) mounted thereon, which button is operable by applying pressure, through the outer surface 15 of the elongate flexible panel 11, at a position 17 overlying the on/off button. The control unit is programmed to deliver a number of therapy treatments for different durations and at different vibration frequencies. A particular treatment is initiated using the on/off button as a programme selector.

The elongate, flexible panel 11 is formed from a single strip of material 18 doubled over on itself, at fold 19, and sealed by adhesive to create a smooth side 20 which faces the limb, in use, and an opposing side 21, in which the recesses 12 and 13 are formed. The strip of material 18 is made from an inner polyurethane foam layer (not shown) bonded to an outer single knit jersey, polyester layer 21.

Figure 2:
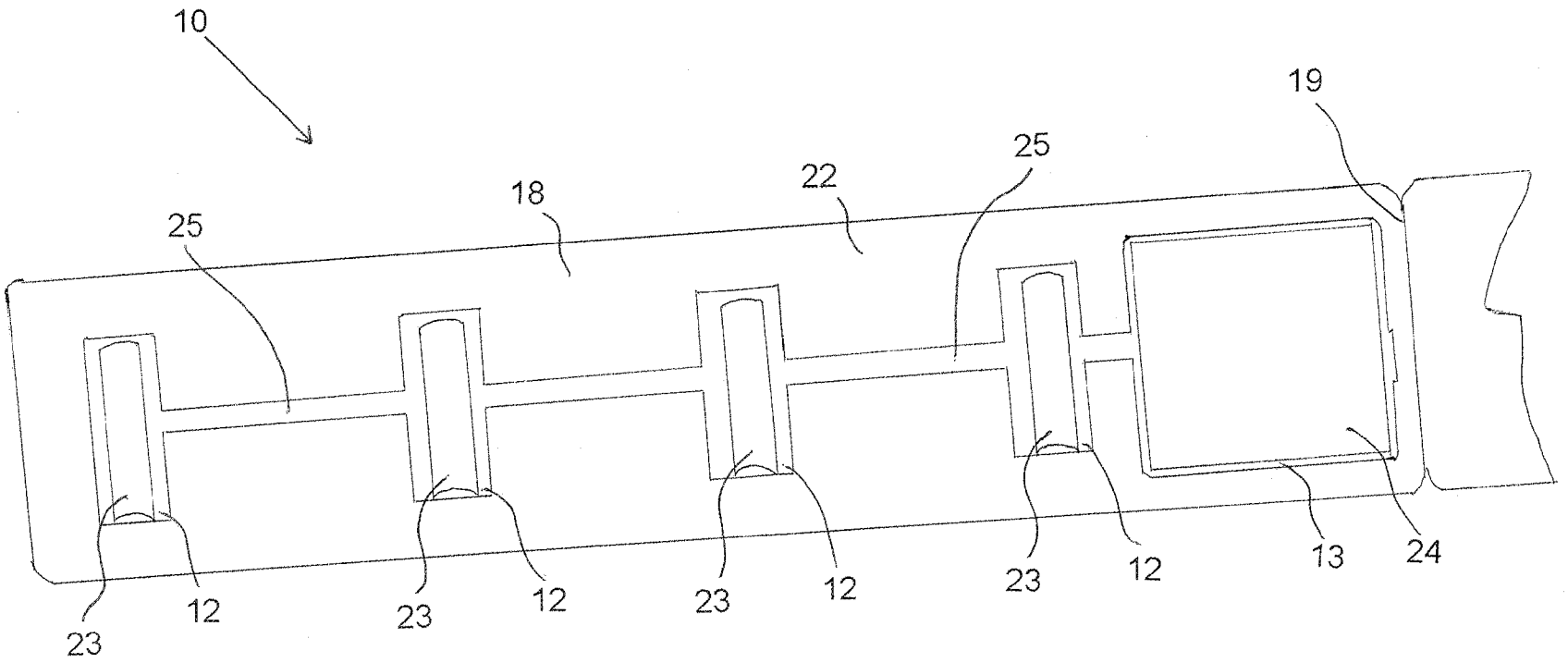
FIG. 2 is a view of the internal layout of the therapeutic device of FIG. 1.

Referring to FIG. 2, the internal layout of the therapeutic device 10 is illustrated. The strip of material 18 has been peeled back, about the fold 19, to reveal the internal components of the therapeutic device 10. Recesses 12 and 13 are formed in the inner polyurethane foam layer 22. An electric motor 23 is located within each recess 12 and the control unit (not shown) lies beneath the rechargeable battery 24 within recess 13.

A channel 25 in the inner polyurethane foam layer 22 connects recess 13 with recesses 12 and accommodates the wiring (not shown for the purposes of clarity), which wiring connects the electric motors 23 to the rechargeable battery 24, through the control unit. As the wiring is embedded within the elongate flexible panel 11 it cannot be interfered with, in use.

The invention claimed is:

1. A therapeutic device for treating a limb of a human or a non-human animal, the therapeutic device comprising:

a wrap having a pocket;

an elongate, flexible panel;

a plurality of recesses formed in the elongate, flexible panel;

a top covering on a top surface of the elongate, flexible panel and a bottom covering on a bottom surface of the elongate, flexible panel;

at least one vibrating source retained in a first recess of the plurality of recesses;

a battery retained in a second recess of the plurality of recesses; and wires extending between the battery and the at least one vibrating source, wherein the wrap is configured to be wrapped around a limb, and wherein the elongate, flexible panel is located within the pocket, the wrap being dimensioned to fit around a part of the limb to be treated.

2. A therapeutic device according to claim 1, wherein the battery is rechargeable and a socket, for attaching a charging unit thereto, is accessibly mounted in the outer surface of the elongate, flexible panel.

3. A therapeutic device according to claim 2, further comprising a control unit, wherein the control unit has an on/off button mounted thereon, which button is operable by applying pressure, through the outer surface of the elongate, flexible panel, at a position overlying the on/off button.

4. A therapeutic device according to claim 1, further comprising a control unit, wherein the control unit has an on/off button mounted thereon, which button is operable by applying pressure, through the outer surface of the elongate, flexible panel, at a position overlying the on/off button.

5. A therapeutic device according to claim 1, further comprising a plurality of vibrating sources, each one of the plurality of vibrating sources being in one of the plurality of recesses; and a channel extends between the plurality of recesses, wherein the wires extend between the plurality of vibrating sources.

6. A therapeutic device according to claim 1, wherein the elongate, flexible panel is made of polyurethane foam.

7. A therapeutic device according to claim 1, wherein the top covering and bottom covering are connected to each other along a fold line.

8. A therapeutic device according to claim 1, wherein the top covering and bottom covering are made from polyester.

9. A therapeutic device according to claim 1, wherein the at least one vibrating source is an electric motor.

10. A therapeutic device according to claim 1, further comprising a channel extending between the first recess and the second recess, wherein the wires extending between the battery and the at least one vibrating source are in the channel.

* * * * *